United States Patent [19]

Baltz et al.

[11] Patent Number: 4,552,103

[45] Date of Patent: Nov. 12, 1985

[54] MANUAL STARTER WITH IGNITION SPARK RETARD

[75] Inventors: Gene F. Baltz, Lake Villa, Ill.; Donovan K. Jourdan, Kenosha, Wis.

[73] Assignee: Outboard Marine Corporation, Waukegan, Ill.

[21] Appl. No.: 649,160

[22] Filed: Sep. 10, 1984

Related U.S. Application Data

[63] Continuation of Ser. No. 529,337, Sep. 6, 1983, abandoned.

[51] Int. Cl.[4] ..... F02P 5/14; F02N 3/00

[52] U.S. Cl. ..... 123/186; 123/185 A; 123/424

[58] Field of Search ..... 123/186, 424, 179 BG, 123/179 SE, 185 A, 185 B, 185 BA, 185 BB

[56] References Cited

U.S. PATENT DOCUMENTS

| | | | |
|---|---|---|---|
| 872,527 | 12/1907 | Manz | 123/186 |
| 984,252 | 2/1911 | Wurmser | 123/186 |
| 1,011,693 | 12/1911 | Winton | 123/186 |
| 1,128,219 | 2/1915 | Bordeaux | 123/185 B |
| 1,200,254 | 10/1916 | Stanley | 123/185 B |
| 1,230,174 | 6/1917 | Krouse | 123/186 |
| 1,272,101 | 7/1918 | Rice | 123/186 |
| 1,368,581 | 2/1921 | Smith | 123/186 |
| 4,230,085 | 10/1980 | Baltz | 123/185 A |

*Primary Examiner*—Andrew M. Dolinar

*Attorney, Agent, or Firm*—Michael, Best & Friedrich

[57] ABSTRACT

A manual starter is provided for an internal combustion engine including a drive member mounted for rotation and operable to start the engine when rotated. The starter includes a flexible pull element mounted for movement between a normally retracted position and an extended position, a mechanism for drivingly engaging the drive member when the flexible pull element is pulled to the extended position, and a retracting mechanism for returning the pull element from the extended position to the retracted position. The starter also includes a guide roller mounted for rotation and in frictional contact with the flexible pull element, and a mechanism responsive to rotation of the guide roller for retarding ignition spark timing as the flexible pull element moves toward the extended position, and for not retarding ignition spark timing as the flexible pull element moves toward the retracted position..

7 Claims, 3 Drawing Figures

MANUAL STARTER WITH IGNITION SPARK RETARD

BACKGROUND OF THE INVENTION

This application is a continuation of application Ser. No. 529,337, filed Sept. 6, 1983, and now abandoned.

This invention relates to starters for internal combustion engines and, more particularly, to manual starters for small internal combustion engines such as engines for outboard motors, lawn mowers and the like and, particularly, those which include means for retarding ignition spark timing.

In order to obtain maximum fuel economy and running quality on an internal combustion engine, a maximum amount of ignition spark advance is required at low engine speeds. This high ignition spark advance at low engine speeds, however, can cause difficulty in engine starting when the engine is equipped with a manual pull-rope type starter. When starting, a high spark advance can cause the engine to momentarily run backwards, resulting in "kickback" or instantaneous rewind of the starter rope. This kickback condition results in a sudden jerk on the starting rope which is objectionable to the engine operator.

Attention is directed to the following U.S. patents which disclose mechanisms for retarding ignition spark advance during the starting of an internal combustion engine.

| Patentee | U.S. Pat. No. | Issued |
|---|---|---|
| Winton | 1,011,693 | Dec. 12, 1911 |
| Smith | 1,368,581 | Feb. 15, 1921 |
| Bordeaux | 1,128,219 | Feb. 9, 1915 |
| Stanley | 1,200,254 | Oct. 3, 1916 |
| Krouse | 1,230,174 | June 19, 1917 |
| Rice | 1,272,101 | July 9, 1918 |
| Baltz | 4,230,085 | Oct. 28, 1980 |

SUMMARY OF THE INVENTION

This invention provides a manual starter for an internal combustion engine including a drive member mounted for rotation and operable to start the engine when rotated. The starter includes a flexible pull element mounted for movement between a normally retracted position and an extended position, means on the pull element for drivingly engaging the drive member when the flexible pull element is pulled to the extended position, and retracting means for returning the pull element from the extended position to the retracted position. The starter also includes a guide roller mounted for rotation and in frictional contact with the flexible pull element, and means responsive to rotation of the guide roller for retarding ignition spark timing as the flexible pull element moves toward the extended position, and for not retarding ignition spark timing as the flexible pull element moves toward the retracted position.

In one embodiment, the responsive means includes a pair of spaced-apart stop pins, a lever between the stop pins, and means for moving the lever to a first position adjacent one of the stop pins in response to rotation of the guide roller in one direction, and for moving the lever to the second position adjacent the other stop pin in response to reverse rotation of the guide roller. The responsive means also includes an electronic ignition control means for retarding ignition spark timing in response to actuation thereof so as to prevent starter kickback, and a microswitch adjacent the lever for activating the electronic ignition control means when the lever is in the first position, and for deactivating the electronic ignition control means when the lever is in the second position.

In one embodiment, the starter further includes a bolt which rotatably supports the guide roller. The lever is also rotatably mounted on the bolt and adjacent the guide roller, and biasing means holds the lever in frictional contact with the guide roller. The bolt includes a head adjacent the lever and the biasing means comprises a spring concentric with the bolt and between the head and the lever.

One of the principal features of the invention is to provide a manual starter for an internal combustion engine which includes ignition spark retarding means to eliminate starter rope kickback during the starting of the engine.

Another of the principal features of the invention is the provision of such a manual starter which has a minimum number of moving parts and which is therefore reliable and easy to maintain.

Other features and advantages of the invention will become apparent to those skilled in the art upon reviewing the following detailed description, the drawings, and in the appended claims.

Figure 1:
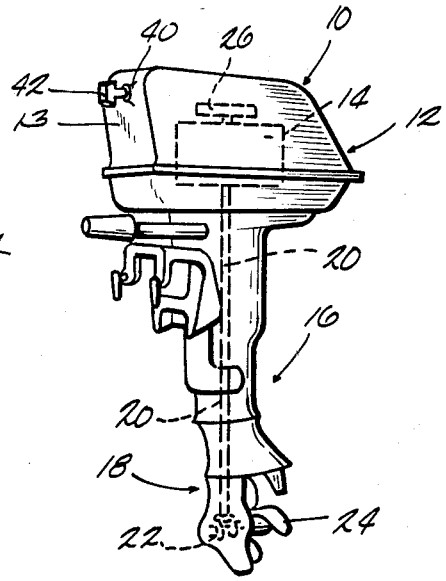
FIG. 1 is a perspective view of an outboard motor including a manual engine starter emboding various of the features of the invention.

Before explaining at least one embodiment of the invention in detail, it is to be understood that the invention is not limited in its application to the details of construction and the arrangements of the components set forth in the following description or illustrated in the drawings. The invention is capable of other embodiment and of being practiced or carried out in various ways. Also it is to be understood that the phraseology and terminology employed herein is for the purposes of description and should not be regarded as limiting.

DESCRIPTION OF THE PREFERRED EMBODIMENT

Illustrated in FIG. 1 is an outboard motor 10 including a power head 12 having a shroud 13 housing an internal combustion engine 14 and a lower unit 16 having a gear case 18. Extending through the lower unit 16 and operably connected to the engine 14 is a drive shaft 20 (illustrated partially and schematically) which drives a propeller shaft 22 extending from the gear case 18 and carrying, on the outer end thereof, a propeller 24. The engine 14 has a rotatable, circular drive member or flywheel 26 which is drivingly connected to the engine crankshaft (not shown) in the usual manner and is operable to start the engine when rotated.

Figure 2:
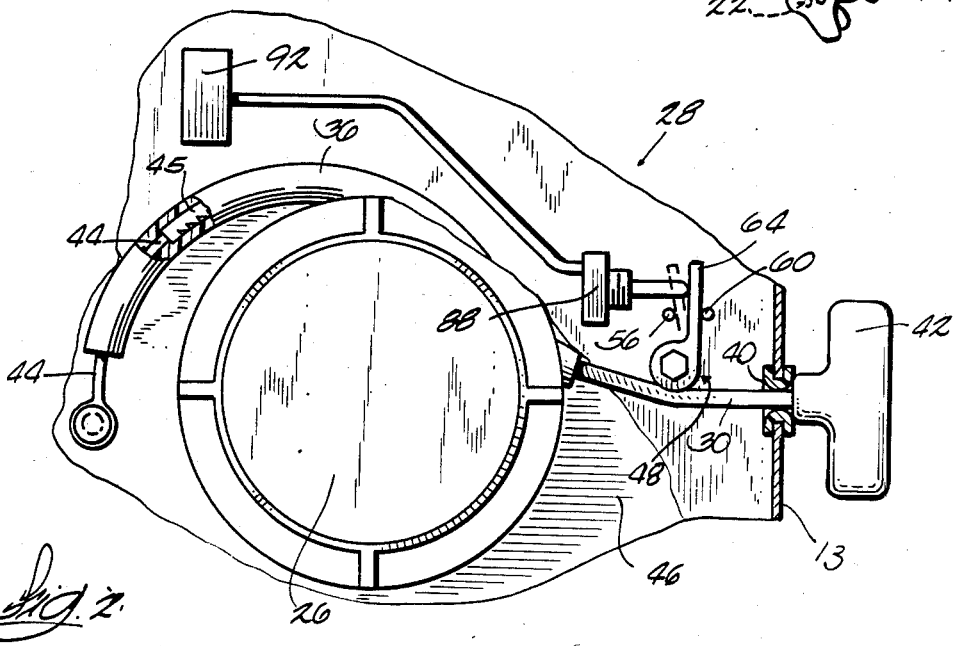
FIG. 2 is an enlarged, partially broken away, perspective view of various components of the starter incorporated in the outboard motor of FIG. 1.

Referring to FIG. 2, the engine 14 is started by a manual starter system 28 including a flexible pull element 30 which is operable, upon being pulled, to drivingly engage and rotate the fly wheel 26 or a similar rotatable member drivingly connected to the engine crankshaft to effect engine starting when rotated. Various means can be used for having the flexible pull element 30 rotate the drive member 26. One such means is the construction disclosed in Baltz U.S. Pat. No. 4,230,085 issued Oct. 28, 1980 and incorporated herein by reference.

The pull element 30 is mounted for movement between a normally retracted position and a pulled out or extended position. While various suitable arrangements can be used, in the speecified construction illustrated, the pull element 30 in FIG. 2 is slidably mounted in a tubular member or storage tube 36 which is located in the vicinity of the fly wheel 26 and is arranged to guide the pull element 30 through an arcuate travel path. The outer or free end of the pull element 30 extends through a guide 40 in the shroud 13 and includes a pull handle 42.

Retracting means are provided for returning the pull element 30 to the retracted position. While various suitable means can be used for this purpose, in the specified construction illustrated, the retracting means includes an elastic member 44 having one end suitably connected to the inner end 45 of the pull element 30 and the other end anchored on the engine block or housing 46. The elastic member 44 is stretched as the pull element 30 is pulled to an extended position and retracts the pull element 30 inside the storage tube 36 to a retracted position, as illustrated in FIG. 2, upon returning to a relaxed or normal position.

Attached to the top of the engine block 46 between the guide 40 and the fly wheel 26 is a guide roller 48 in frictional contact with the flexible pull element 30. The guide roller 48 is rotatable in resonse to movement in either direction of the flexible pull element 30.

Means 52 responsive to rotation of the guide roller 48 is provided for retarding the engine spark timing as the flexible pull element 30 moves to and assumes the extended position, and for not retarding the ignition spark timing as the flexible pull element 30 returns to and assumes the retracted position. The responsive means 52 includes a pair of stop pins 56 and 60 fixed adjacent the guide roller 48, and a lever 64 which extends between the stop pins 56 and 60.

Figure 3:
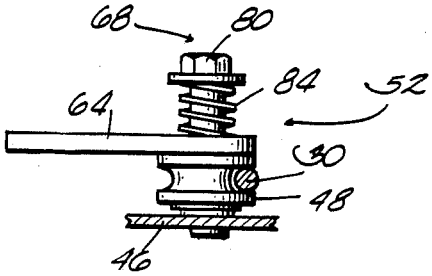
FIG. 3 is a fragmentary view of the guide roller incorporated in the manual starter illustrated in FIG. 2.

As illustrated in FIG. 3, the lever 64 is in frictional contact with the guide roller 48 and movable in response to rotation of the guide roller 48 by mounting the lever 64 and guide roller 48 on a bolt 68 which extends perpendicularly from the top of the engine block 46. In other embodiments, the bolt 68 and stop pins 56 and 60 can extend downward from the engine shroud 13.

Means is provided for holding the lever 64 in frictional contact with the guide roller 48 so as to cause pivotal movement of the lever 64 in response to rotational movement of the guide roller 48. While other constructions can be employed, in the illustrated construction, the bolt 68 includes an end with a head 80 which is larger than the cross-sectional diameter of the bolt 68, and the lever 64 is held in frictional contact with the guide roller 48 by means in the form of a spring 84 concentric with the bolt 68 and extending between the bolt head 80 and the lever 64.

As illustrated by the solid and dashed lines in FIG. 2, the lever 64 is movable between a first position adjacent the stop pin 56 in response to rotation of the guide roller 48 in one direction, and a second position adjacent the other stop pin 60 in response to reverse rotation of the guide roller 48.

Means for retarding ignition timing in response to movement of the lever 64 is provided in the form of a microswitch 88 adjacent the lever 64 and operably connected to a schematically illustrated electronic ignition control 92. The electronic ignition control 92 is connected to the engine spark timing system (not shown) to retard engine spark timing when activated. Any suitable control can be employed, and the details of such a control are not regarded as part of the invention.

When the lever 64 moves to the first position adjacent the stop pin 56, the microswitch 88 is engaged and activates the electronic ignition control 92 for retarding ignition spark timing. When the lever 64 is in the second position adjacent the other stop pin 60, the electronic ignition control 92 is deactivated so ignition spark timing is not retarded.

In operation, the operator grasps the pull handle 42 and pulls the flexible pull element 30 from its retracted position to its extended position. While the flexible pull element 30 is being moved to its extended position, the flexible pull element 30 engages the fly wheel 26 to start the engine 14. While starting the engine 14, the flexible guide element 30 also rotates the guide roller 48 in a counterclockwise manner, when viewed from above as illustrated in FIG. 2. This moves the lever 64 from adjacent stop in 60 to adjacent the stop pin 56, thus activating the ignition electronic control 92 and retarding spark timing. After staring the engine 14, the operator releases the pull handle 42 and the flexible element 30 is bought back by the elastic member 44 to the retracted position. As the flexible pull element 30 returns to the retracted position, the guide roller 48 is rotated in a clockwise manner, when viewed from above and as illustrated in FIG. 2, and the lever 64 moves to the second position adjacent the other stop pin 60. The lever 64 thus releases the microswitch 88 and the electronic ignition control 92 no longer retards the ignition spark timing.

Various of the features of the invention are set forth in the following claims.

We claim:

1. A manual starter for an internal combustion engine including a drive member mounted for rotation and operable to start the engine when rotated, said starter including a flexible pull element mounted for movement between a normally retracted position and an extended position, means on said pull element for drivingly engaging the drive member when said flexible pull element is pulled to the extended position, retracting means for returning said pull element from an extended position to the retracted position, a guide roller mounted for rotation and in frictional contact with said flexible pull element, and means responsive to rotation of said guide roller for retarding ignition spark timing as said flexible pull element moves toward the extended position, and for not retarding ignition spark timing as said flexible pull element moves toward the retracted position.

2. A manual starter in accordance with claim 1 wherein said responsive means includes a pair of stop pins, and a lever between said stop pins, means for moving said lever to a first position adjacent one of said stop pins in response to rotation of said guide roller in one direction, and for moving said lever to a second position adjacent said other stop pin in response to reverse rotation of said guide roller.

3. A manual starter in accordance with claim 2 wherein said responsive means further includes an electronic ignition control means for retarding ignition spark timing in response to actuation thereof so as to prevent starter kickback, and a microswitch adjacent said lever for activating said electronic ignition control means when said lever is in said first position, and for deactivating said electronic ignition control means when said lever is in said second position.

4. A manual starter in accordance with claim 2 wherein said mannual starter further includes a bolt which rotatably supports said guide roller, and wherein said means for moving said lever comprises rotational mounting of said lever on said bolt adjacent said guide roller, and biasing means for holding said lever in frictional contact with said guide roller.

5. A manual starter in accordance with claim 4 wherein said bolt includes a head, and wherein said lever is adjacent said head, and wherein said biasing means comprises a spring concentric with said bolt and between said head and said lever.

6. A manual starter for an internal combustion engine including a drive member mounted for rotation and operable to start the engine when rotated, said starter including a flexible pull element mounted for movement between a normally retracted position and an extended position and operably engageable with the drive member to start the engine in response to movement of said flexible pull element to an extended position, said means for retarding ignitiion spark timing in response to movement of said flexible pull element toward an extended position, said means for retarding spark timing, including a movably mounted member in which is located in frictional contact with said pull element and which is movable in response to movement of said pull element toward the extended position, and means responsive to movement of said member for retarding spark timing.

7. A manual starter for an internal combustion engine including a drive member mounted for rotation and operable to start the engine when rotated, said starter including a flexible pull element mounted for movement in opposite directions between a normally retracted position and an extended position and operably engageable with the drive member in response to movement of said flexible pull element to an extended position, and timing control means for providing retarded ignition spark timing in response to movement of said flexible pull element toward an extended position, and for providing ignition spark timing without retard in response to movement of said flexible pull element toward the retracted position, said timing control means including a member which is mounted in frictional contact with said pull element and which is movable in opposite directions in response to opposite movements of said pull element, and means responsive to movement of said member in one direction for providing retarded ignition spark timing and response to movement in the direction opposite said one direction for providing spark timing without spark retard.

* * * * *